United States Patent [19]

Lewis

[11] 4,047,647

[45] * Sept. 13, 1977

[54] DISPENSER FOR GRANULAR MATERIAL

[76] Inventor: Richard C. Lewis, 464 Green Bay Road, Winnetka, Ill. 60093

[ * ] Notice: The portion of the term of this patent subsequent to Sept. 30, 1992, has been disclaimed.

[21] Appl. No.: 617,024

[22] Filed: Sept. 26, 1975

Related U.S. Application Data

[63] Continuation-in-part of Ser. No. 389,165, Aug. 17, 1973, Pat. No. 3,908,873.

[51] Int. Cl.[2] ..... B67D 3/00

[52] U.S. Cl. ..... 222/480; 222/532; 222/535

[58] Field of Search ..... 222/556, 537, 544, 547, 222/569, 565, 534, 535, 480, 484–486, 481, 483, 189, 532; 229/7 R, 7 SC, 14 R

[56] References Cited

U.S. PATENT DOCUMENTS

| | | | |
|---|---|---|---|
| 2,903,167 | 9/1959 | Eckles | 222/480 |
| 3,908,873 | 9/1975 | Lewis | 222/480 |

*Primary Examiner*—Robert B. Reeves
*Assistant Examiner*—H. Grant Skaggs
*Attorney, Agent, or Firm*—Everett A. Johnson

[57] ABSTRACT

A salt dispenser includes a container with the top having a pouring aperture and a plurality of sifting apertures disposed thereabout. A spout is pivotably secured to the top of the container so that when the sifting apertures are open the pouring aperture is sealed off, and when the pouring aperture is open the sifting apertures are sealed off. More particularly, the spout contains a front piece located outside the container and an integral flange extending therein. When the flange is aligned with the sifting apertures, thus sealing them off, the front piece is in an upright position relative to the pouring aperture, thereby permitting salt to pour out. When the front piece is pivoted to a closed position, thereby sealing the pouring aperture, the flange inside the container is brought out of alignment with the sifting apertures, thus opening them up.

The dispenser and spout herein disclosed can selectively permit pouring or sifting of granular material by providing a unique spout cooperating with sifting and pouring apertures, whereby a single manipulation of the spout is needed to alternate between the pouring and sifting functions. There is disclosed dispenser means comprising a single opening having bulk pour and drag sift apertures with the unique spout configuration segregating the pour aperture section from the array of sifter apertures, and controlling the alternate functions by flipping the spout from one position to another.

10 Claims, 14 Drawing Figures

DISPENSER FOR GRANULAR MATERIAL

RELATED PATENT APPLICATION

This application is a continuation-in-part of my copending application Serial No. 389,165, filed August 17, 1973, now U.S. 3,908,873, entitled Dispenser for Granular Material.

BACKGROUND OF THE INVENTION

This invention relates to a dispenser for alternatively pouring or sifting granular material, particularly salt. In the past, such dual-purpose salt dispensers generally utilized two separate spouts in order to achieve the selected pouring or sifting function. Thus, for example, in order to pour salt from the container, the sifting spout had to be independently closed, and the separate pouring spout had to be opened. Conversely, in order to sift or to sprinkle salt from the container, the pouring spout had to be closed, and the separate sifting spout independently opened.

The disclosed invention overcomes many of the shortcomings of the prior devices in providing a unitary drag sifter and pouring spout. It is neither of costly nor complex construction, embodying fabricating techniques readily acceptable to the packaging art; it is not awkward to manipulate, the consumer being called upon to neither acquire new skills, nor to drop any present habits; and it is eminently convenient for selective dispensing of the product.

GENERAL DESCRIPTION OF THE INVENTION

The salt dispenser herein disclosed, can alternatively permit pouring or sifting of salt through the use of a single integral spout, whereby only one adjustment is needed to alternate between the pouring and sifting functions. More particularly, the spout disclosed herein operates in such a way that an adjustment for pouring salt, automatically precludes sifting, and an adjustment for sifting salt, automatically precludes pouring. The spout, moreover, will remain secure in the desired position of adjustments, thereby preventing inadvertent pouring when sifting is desired, and similarly, thereby preventing sifting, when pouring is desired.

The dispenser includes a container with the top having a pouring aperture and a plurality of sifting apertures disposed thereabout. A spout is pivotably secured to the top of the container so that when the sifting apertures are open the pouring aperture is sealed off, and when the pouring aperture is open the sifting apertures are sealed off. More particularly, the spout contains a front piece located outside the container and an integral flange extending therein. When the flange is aligned with the sifting apertures, thus sealing them off, the front piece is in an upright position relative to the pouring aperture, thereby permitting salt to pour out. When the front piece is pivoted to a closed position, thereby sealing the pouring aperture, the flange inside the container is brought out of alignment with the sifting apertures, thus opening them up.

BRIEF DESCRIPTION OF THE DRAWINGS

Other objects and features of the invention will be seen upon reading a description of the invention in conjunction with the accompanying drawings in which.

DESCRIPTION OF THE ILLUSTRATED EMBODIMENTS

Figure 1:
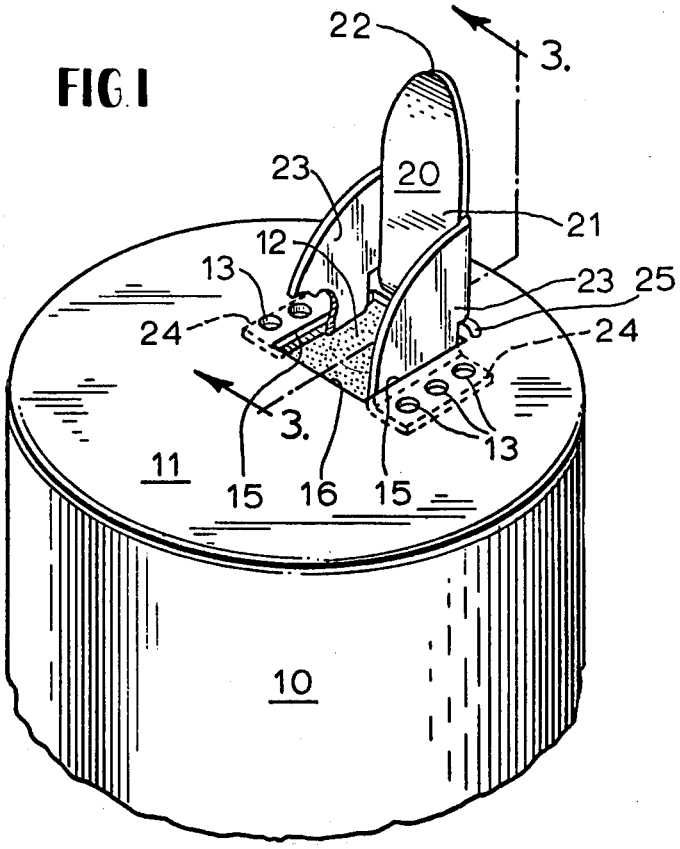
FIG. 1 is a perspective view of the improved dispenser showing an aperture for pouring salt in an open or unsealed position, and apertures for shifting salt sealed off.
Figure 2:
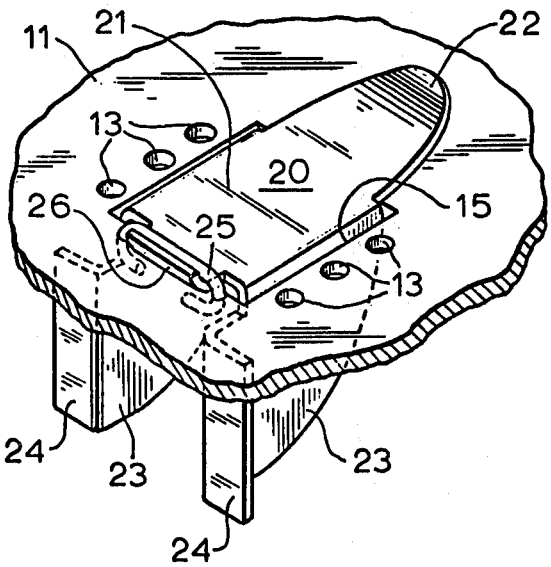
FIG. 2 is a perspective view of the improved salt dispenser with the sifting apertures open and the pouring aperture sealed off.

Referring now to the drawings, and particularly to FIG. 1 and 2, a cylindrical container 10, made for example from cardboard or a similar material, has a round top 11. The wall 11 has an elongated pouring aperture 12 (best seen in FIG. 1 and 5) of sufficient size to permit the rapid pouring of small granular material and which defines in top 11 a pair of side edges 15 and a front edge 16. Top 11 further has a plurality of sifting apertures 13, disposed about the periphery of pouring aperture 12 in close proximity to edges 15. Sifting apertures 13 are of small size relative to pouring aperture 12, thereby permitting the granular material packaged in container 10 to be sifted or sprinkled therefrom.

Figure 3:
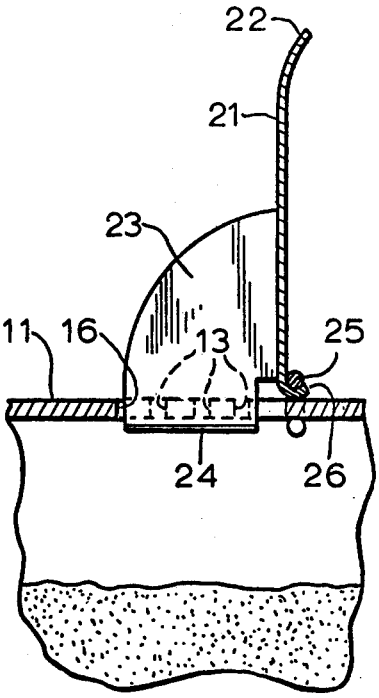
FIG. 3 is a sectional view taken across line 3—3 of FIG. 1, showing the pouring aperture in its open or unsealed position.
Figure 4:
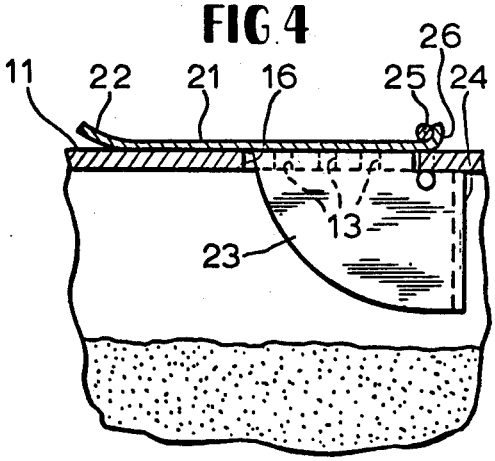
FIG. 4 is a sectional view of the same portion of the dispenser shown in FIG. 3, except that the pouring aperture is shown in its sealed position.

An integral spout 20, preferably stamped from a sheet of metal, includes an elongated front piece 21 having a tapered end 22 and a pivot end 26. Front piece 21, which is of slightly larger size than pouring aperture 12, is pivotably secured to top 11 by means of a pin or a staple 25 attached to pivot end 26. Spout 20 also includes a pair of sidewalls 23, substantially perpendicular to the plane defined by front piece 21, extending into container 10. Sidewalls 23 extend from pivot end 26, in frictional contact with edges 15, toward tapered end 22, a distance equal to the elongated length of pouring aperture 12. Sidewalls 23 thus remain in constant contact with front edge 16, thereby serving to funnel salt out of container 10 when pouring aperture 12 is open, and helping to seal off pouring aperture 12 when it is closed. These functions of sidewalls 23 are best illustrated in FIGS. 3 and 4, respectively.

Spout 20 further includes a pair of flanges 24 secured to and extending outwardly from sidewalls 23 in such a way as to fit flush against sifting apertures 13 when front piece 21 of spout 20 is adjusted to an upright position as shown in FIG. 1. When so adjusted, flanges 24 seal off sifting apertures 13, thereby preventing salt from escaping therethrough. At the same time, pouring aperture 12 is opened or unsealed, thus permitting salt to be poured from container 10 through pouring aperture 12 and spout 20.

Spout 20 can be conveniently adjusted to seal off pouring aperture 12 by manually pushing tapered end 22 into contact with top 11 of container 10 as shown in FIG. 2. In this position of pivotable adjustment, front piece 21 of spout 20 overlies and seals off pouring aperture 12. At the same time, flanges 24 are pivoted out of contact with sifting apertures 13, thereby unsealing apertures 13 and permitting salt to be sifted or sprinkled therethrough if desired.

As described hereinbefore, sidewalls 23 are in frictional contact with edges 15 throughout the entire range of pivotal adjustment of spout 20. Thus, when pouring aperture 12 is unsealed by pivotally adjusting front piece 21 to an upright position, the frictional forces between edges 15 anc sidewalls 23 maintain spout 20 in that position of adjustment. Similarly, when pouring aperture 12 is sealed off by pivoting tapered end 22 into contact with top 11, thereby moving spout 20 to a horizontal position, the frictional forces between edge 15 and sidewalls 23 maintain spout 20 in that position of adjustment as well. It should be also observed, that, if desired, tapered end 22 can be manually held in place to insure that pouring aperture 12 will remain sealed during a particularly vigorous shaking of salt through sifting apertures 13. In the event additional protection is needed or desired, means can be provided to mechanically lock spout 20 in either its upright or horizontal position. Finally, as shown best in FIGS. 3 and 4, tapered end 22 can be provided with a lip, raised slightly above the plane of front piece 21 so that a finger or fingernail can be easily inserted between tapered end 22 and top 11 to pry up front piece 21, thereby unsealing pouring aperture 12.

From the foregoing description it will be apparent that I have provided several embodiments of a combined pouring and sifting closure device for attachment to an apertured outlet portion of a container.

In the embodiments of FIG. 5–8 and FIGS. 9–11 the flange closure means operating within the container comprises a single flange 24 extending normal to the side wall 23 and substantially radially from the pivotal support for the spout.

Stated in another way, the dispenser comprises a plurality of sifting apertures 13 disposed in separate arrays 13a along the boundary of the pouring aperture 12 and are sealed or unsealed by the pivotal position of the closure flange **24*a*.**

Figure 5:
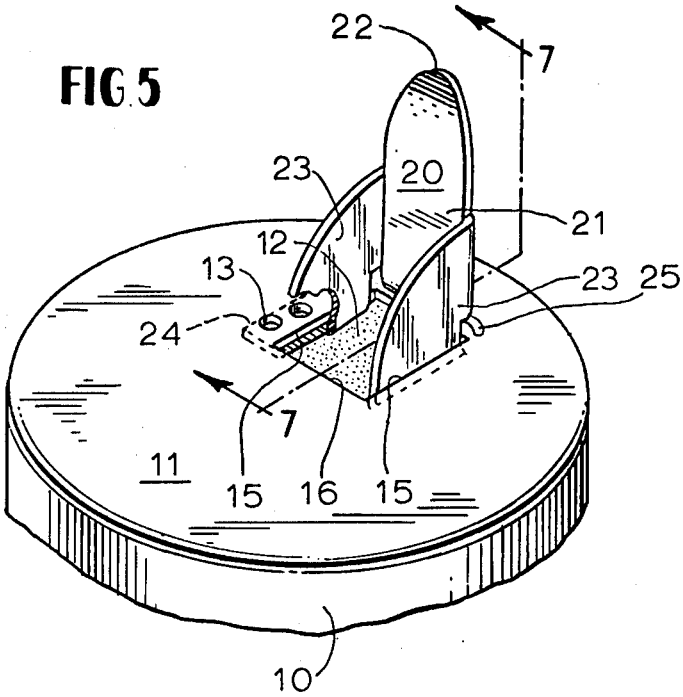
FIG. 5 is a perspective view of my dispenser showing the pouring aperture in an open or unsealed position, and the sifting apertures closed or sealed.
Figure 7:
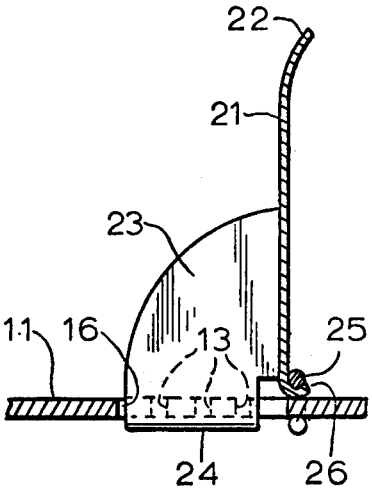
FIG. 7 is a sectional view taken across line 7—7 in FIG. 5, showing the pouring aperture in its open or unsealed condition.
Figure 6:
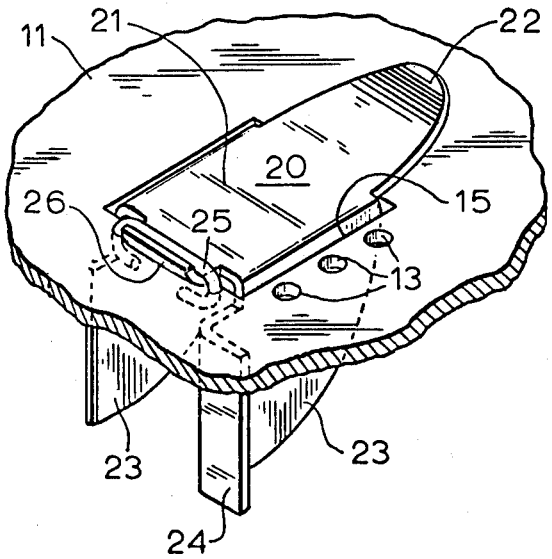
FIG. 6 is a perspective view of this second embodiment with a single array of sifting apertures in an open position with the pouring aperture sealed.
Figure 8:
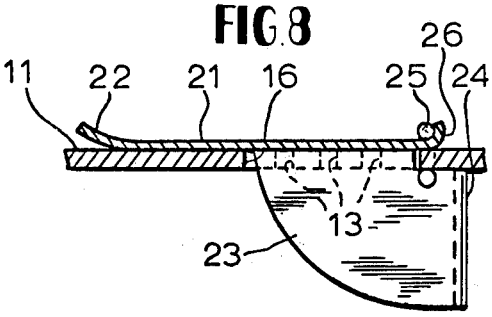
FIG. 8 is a sectional view of the same portion of the dispenser shown in FIG. 7, except that the pouring aperture is shown sealed.

Referring to FIG. 5–8, the dispenser comprises a container 10 having an apertured top 11 provided with the pouring aperture 12 and a plurality of sifting apertures 13. The spout 20 comprises a pivotal closure panel 21 with sidewalls 23 extending from the closure panel 21 through the trapezoidal pouring aperture **12*a*. The spout 20 is pivotally secured to the top wall 11 of the container 10, and is adapted, when in a first position of pivotal adjustment, to overlie and seal off the pouring aperture as shown in FIG. 6 and FIG. 8.**

Figure 9:
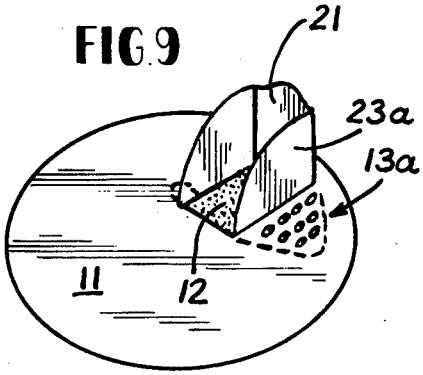
FIG. 9 and FIG. 10 are perspective views of a third embodiment, the pouring aperture being open in FIG. 9 and closed in FIG. 10.
Figure 10:
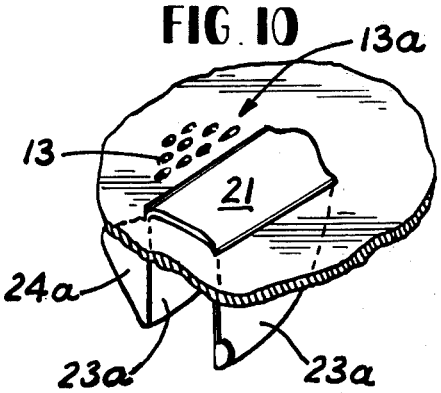

The closure flange means 24 is secured to the sidewall **23*a* extending within the pouring aperture 12 and adapted to seal the side edges of the aperture 12 and to overlie and seal off the sifting apertures 13 as shown in FIG. 5 and FIG. 7 when the closure panel 21 is in the second position of pivotal adjustment. The pouring aperture 12 unsealed when the closure panel 21 is in the second position; and the sifting apertures 13 are unsealed when the spout 20 is in the first position of FIG. 6 and FIG.8. FIG. 9 and FIG. 10 illustrate another embodiment of the invention having an array 13*a* of shifting apertures 13 gated by the flanged closure spout shown free of container structure in FIG. 11. The closure flange 24*a* carried by a sidewall 23*a* of the spout conforms generally to the array 13*a* and is adapted to overlie and seal the sifting apertures (FIG. 9). Other sifting arrays (13*b*,** —*c*, and **13*d*) are shown in FIG. 12, 13, and 14.**

Figure 12:
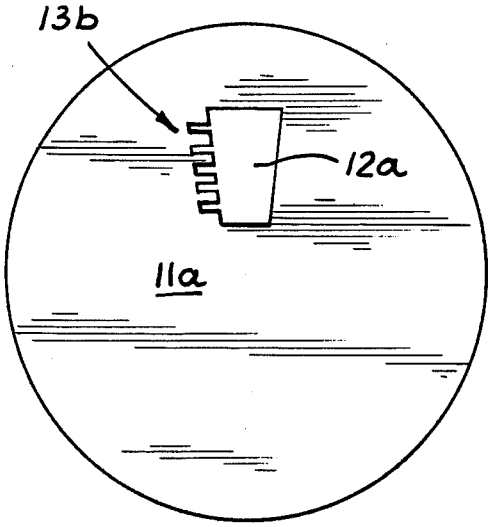
FIG. 12, 13, and 14 are plan views of alternative aperture arrangements in a dispenser top wall, the spout 20 (as in FIG. 11) having been omitted for clarity in illustration.
Figure 13:
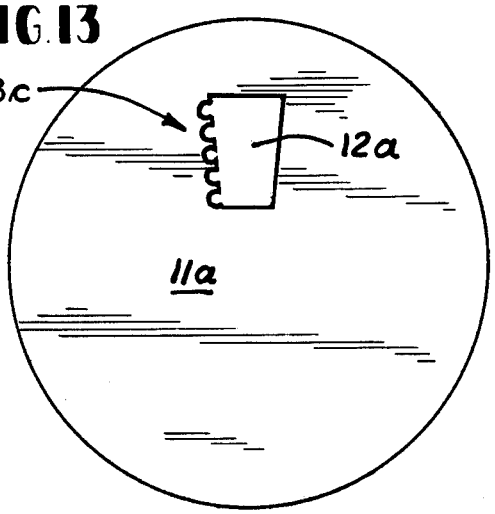
Figure 14:
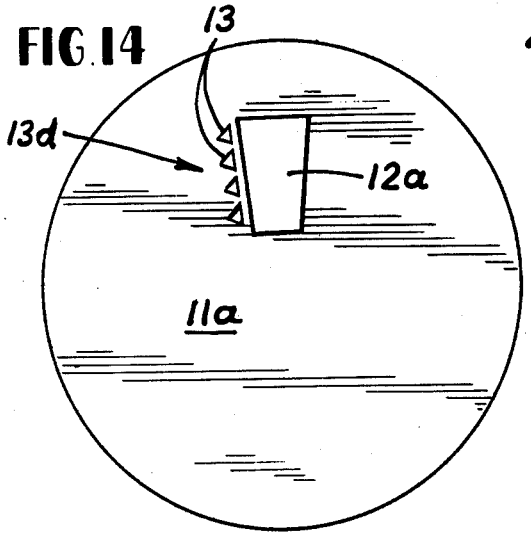
Figure 11:
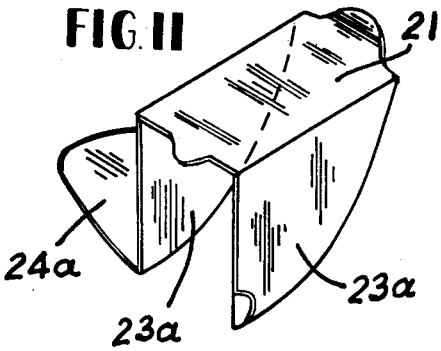
FIG. 11 is a perspective view of the spout closure shown in the assemblies of FIG. 9 and 10.

In FIG. 11, I have shown a spout construction adaptable for use in any of the end walls **11*a* shown in FIG. 12, 13, or 14, and in FIG. 9 and 10.**

Referring to FIGS. 12, 13, and 14, each represents an apertured wall **11*a* with a trapezoidal pouring aperture 12*a* and additional arrays of sifting apertures 13*b*, 13*c*, and 13*d*. In FIG. 12 and FIG. 13 the sifting aperture arrays 13*b* and 13*c* are (in the absence of spout 20) in direct communication with the pouring aperture 12*a*, but when the spout 20 is in place, the sidewall 23*a* of the spout provides a barrier between the array of sifting apertures and the pouring aperture 12*a*.**

The converging side edges of the generally trapezoidal aperture **12*a* as shown in FIG. 12–14 embrace the sidewalls 23*a* of the spout 20** sealing the edges of the pouring aperture and frictionally holding the spout in stable pivotal positions while separating the sifting array from the pour aperture.

Reverting to the embodiment illustrated by FIG. 5 through 8, its operation is similar to that described with reference to FIG. 1 to 4, and includes but one closure flange 24 which is coextensive with, and adapted to overlie and seal, a single array of sifting apertures 13 as here shown as also illustrated by FIG. 9 to 11. The elements of the structure function as described for FIG. 1 to 4, and the corresponding components are identified by similar reference symbols where appropriate.

The invention should not be limited to the embodiments thereof herein disclosed, but is entitled to the scope defined by the claims.

I claim:

1. A dispenser for pouring or sifting granular material having an apertured wall and including a trapezoidal pouring aperture and a plurality of sifting apertures; a spout having a first closure panel of generally trapezoidal shape adapted when in a first position of pivotal adjustment to overlie and seal off said pouring aperture; a pair of spout sidewalls extending from opposite sides of said closure panel and inwardly of said pouring aperture; and second closure means carried by at least one of said sidewalls within said dispenser adapted to seal off said sifting apertures when said first closure panel is in a second position of pivotal adjustment, said pouring aperture discharging through said spout when said closure panel is in said second position and said sifting apertures are unsealed when said closure panel is in said first position.

2. The dispenser of claim 1 including a single array of sifting apertures adjacent an edge of said pouring aperture and wherein said second closure means comprises a single flange adapted to overlie and seal said array when said first closure panel is in said second discharge position.

3. The dispenser of claim 1 wherein the apertured wall is the top end wall of a container and the sifting apertures comprise at least one array of apertures defining an edge of the pouring aperture, at least one spout sidewall being interposed between the said pouring aperture and the said one array of sifting apertures.

4. The dispenser of claim 1 wherein the apertured wall is an end wall of a container and the sifting apertures comprise at least one array of apertures forming an edge of the pouring aperture with one spout sidewall separating the said pouring aperture and said array from each other.

5. The dispenser of claim 4 wherein said array of sifting apertures comprises a series of notches in the border of the pouring aperture.

6. The dispenser of claim 1 including a pair of spaced arrays of sifting apertures, said second closure means comprising a pair of flanges coextensive with the said spaced arrays which are unsealed when said spout is in said first closure position and are sealed when said spout is in said second discharge position.

7. The dispenser of claim 1 including arrays of sifting apertures adjacent opposite edges of said pouring aperture and wherein said second closure means comprises a pair of closure flanges, each adapted to underlie and seal an array when said spout is in said second discharge position.

8. The dispenser of claim 7 wherein the arrays and the closure flanges are of corresponding area and configuration.

9. The dispenser of claim 1 wherein the said spout includes a generally triangular shaped flange substantially coextensive in area with a generally triangular array of sifting apertures.

10. The dispenser of claim 1 wherein the said closure panel and the said pouring aperture are of generally trapezoidal configuration.

* * * * *